US008155547B2

(12) United States Patent
Condello et al.

(10) Patent No.: US 8,155,547 B2
(45) Date of Patent: Apr. 10, 2012

(54) APPARATUSES USEFUL FOR PRINTING AND CORRESPONDING METHODS

(75) Inventors: Anthony S. Condello, Webster, NY (US); Augusto E. Barton, Webster, NY (US); David M. Thompson, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 501 days.

(21) Appl. No.: 12/492,542

(22) Filed: Jun. 26, 2009

(65) Prior Publication Data

US 2010/0329716 A1 Dec. 30, 2010

(51) Int. Cl.
*G03G 15/20* (2006.01)
*G03G 21/00* (2006.01)
*G03G 21/20* (2006.01)

(52) U.S. Cl. ..... 399/67; 399/45; 399/69; 399/341

(58) Field of Classification Search ..... 399/45, 399/67, 69, 330, 331, 341
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 5,489,969 | A | 2/1996 | Soler et al. |
| 5,568,246 | A | 10/1996 | Keller et al. |
| 5,570,172 | A | 10/1996 | Acquaviva |
| 5,596,416 | A | 1/1997 | Barry et al. |
| 5,995,721 | A | 11/1999 | Rourke et al. |
| 6,554,276 | B2 | 4/2003 | Jackson et al. |
| 6,607,320 | B2 | 8/2003 | Bobrow et al. |
| 6,654,136 | B2 | 11/2003 | Shimada |

(Continued)

FOREIGN PATENT DOCUMENTS

| | | | |
|---|---|---|---|
| JP | 10010883 A | * | 1/1998 |
| JP | 2002278179 A | * | 9/2002 |
| JP | 2007017495 A | * | 1/2007 |

OTHER PUBLICATIONS

Augusto E. Barton; "Fuser With Gloss Feedback Control"; U.S. Appl. No. 12/052,767, filed Mar. 21, 2008.

(Continued)

*Primary Examiner* — David Gray
*Assistant Examiner* — Fred L Braun
(74) *Attorney, Agent, or Firm* — Ronald E. Prass, Jr.; Prass LLP

(57) ABSTRACT

Apparatuses useful for printing and methods of are provided. The apparatus includes a user interface for operating the printing apparatus, a fuser for fusing media, the fuser having a plurality of temperature settings, a gloss meter for measuring gloss of an image fused on the media, and a controller controlling the printing apparatus, wherein the controller: a) causes fusing of a plurality of media of a first type at a nominal fusing temperature, and then measuring a temperature of the pressure roll as a steady state pressure roll temperature, b) causes media of the first type to be input to the fuser to fuse an image onto the media, the fuser having a first fusing temperature, c) causes the gloss meter to measure a gloss level of the image fused on the media, and sending the measured gloss level with the first type of media to the controller, d) causes steps b) and c) to be repeated at various fusing temperatures different from the first fusing temperature, and saving the measured gloss levels with corresponding fuser temperatures, e) in response to a user indication of a desired gloss level received over the user interface, sets a temperature of the pressure roll to the steady state pressure roll temperature, and f) fuses media utilizing one of the measured fusing temperatures corresponding to the desired gloss level.

20 Claims, 4 Drawing Sheets

U.S. PATENT DOCUMENTS

| | | | | |
|---|---|---|---|---|
| 6,823,150 | B1 * | 11/2004 | Cao et al. | 399/69 |
| 7,263,305 | B2 * | 8/2007 | Fujino | 399/69 |
| 7,305,198 | B2 * | 12/2007 | Julien | 399/69 |
| 7,831,164 | B2 * | 11/2010 | Barton | 399/69 |
| 7,877,053 | B2 * | 1/2011 | Ng et al. | 399/341 |
| 7,907,858 | B2 * | 3/2011 | Monahan et al. | 399/67 |
| 2003/0063916 | A1 * | 4/2003 | Katayanagi et al. | 399/45 |

OTHER PUBLICATIONS

William A. Burton et al.; "Apparatuses Useful for Printing and Methods of Stripping Media From Surfaces in Apparatuses Useful for Printing"; U.S. Appl. No. 12/363,724, filed Jan. 31, 2009.

* cited by examiner

APPARATUSES USEFUL FOR PRINTING AND CORRESPONDING METHODS

BACKGROUND

In some printing apparatuses, images are formed on media using a marking material, such as toner. Such printing apparatuses can include a fuser having a roll and a belt that define a nip. Media are fed to the nip and heated to treat the marking material. A resultant gloss is imparted to the image fused to the media. The gloss is heavily dependent on the physical and chemical properties of the media being fused. For example, a gloss level for an image fused to two different media, such as a lightweight media and a heavyweight media, or a coated media and an uncoated media, may vary substantially if the same fusing temperatures are applied to each media.

It would be desirable to provide apparatuses useful for printing and methods that can learn appropriate fusing temperatures for different media to achieve various gloss levels. Then, a desired gloss level may be more reliably obtained.

SUMMARY

Apparatuses useful for printing and methods of are provided. The apparatus includes a user interface for operating the printing apparatus, a fuser for fusing media, the fuser having a plurality of temperature settings, a gloss meter for measuring gloss of an image fused on the media, and a controller controlling the printing apparatus, wherein the controller: a) causes fusing of a plurality of media of a first type at a nominal fusing temperature, and then measuring a temperature of the pressure roll as a steady state pressure roll temperature, b) causes media of the first type to be input to the fuser to fuse an image onto the media, the fuser having a first fusing temperature, c) causes the gloss meter to measure a gloss level of the image fused on the media, and sending the measured gloss level with the first type of media to the controller, d) causes steps b) and c) to be repeated at various fusing temperatures different from the first fusing temperature, and saving the measured gloss levels with corresponding fuser temperatures, e) in response to a user indication of a desired gloss level received over the user interface, sets a temperature of the pressure roll to the steady state pressure roll temperature, and f) fuses media utilizing one of the measured fusing temperatures corresponding to the desired gloss level.

DRAWINGS

DETAILED DESCRIPTION

Figure 1:
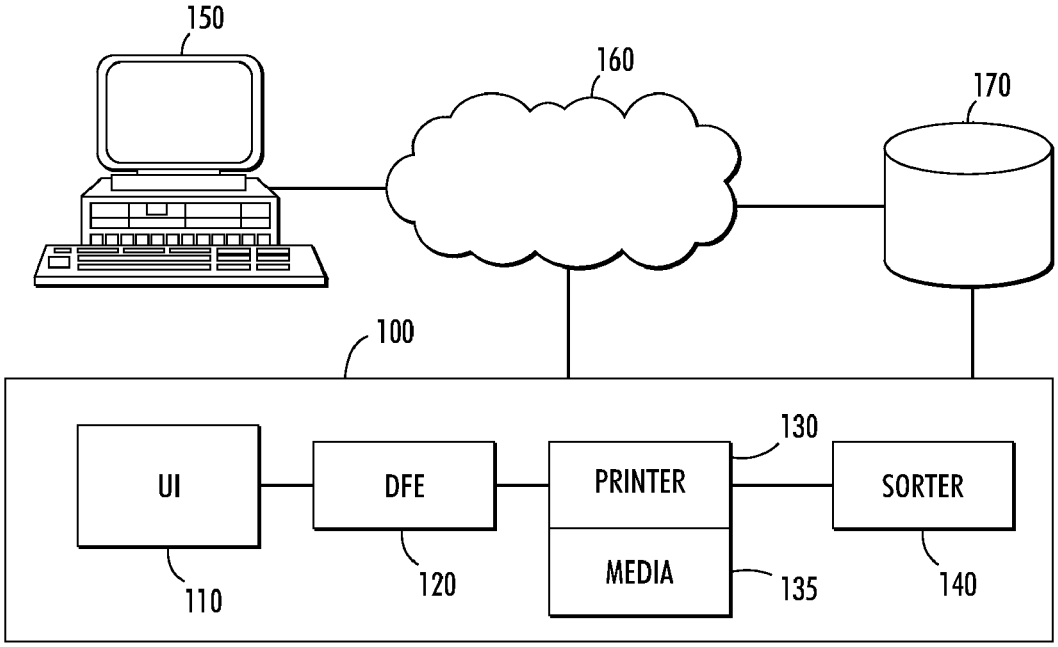
FIG. 1 depicts an exemplary embodiment of a printing apparatus.

The disclosed embodiments include an apparatus useful for printing. The apparatus includes a user interface for operating the printing apparatus, a fuser for fusing media, the fuser having a plurality of temperature settings, a gloss meter for measuring gloss of an image fused on the media, and a controller controlling the printing apparatus, wherein the controller: a) causes fusing of a plurality of media of a first type at a nominal fusing temperature, and then measuring a temperature of the pressure roll as a steady state pressure roll temperature, b) causes media of the first type to be input to the fuser to fuse an image onto the media, the fuser having a first fusing temperature, c) causes the gloss meter to measure a gloss level of the image fused on the media, and sending the measured gloss level with the first type of media to the controller, d) causes steps b) and c) to be repeated at various fusing temperatures different from the first fusing temperature, and saving the measured gloss levels with corresponding fuser temperatures, e) in response to a user indication of a desired gloss level received over the user interface, sets a temperature of the pressure roll to the steady state pressure roll temperature, and f) fuses media utilizing one of the measured fusing temperatures corresponding to the desired gloss level.

The disclosed embodiments further include an apparatus useful for printing that includes a user interface for operating the printing apparatus, a fuser for fusing media, the fuser having a fuser roll with a heater, a pressure roll with a heater, the fuser roll and the pressure roll forming a nip for fusing media, and having heater rolls adjacent the fuser roll for applying heat to the fuser roll, a gloss meter for measuring gloss of an image fused on the media, and a controller controlling the printing apparatus, wherein the controller determines gloss levels of media for a plurality of fuser temperatures by: a) causing fusing of a plurality of media of a first type at a nominal fusing temperature, and then measuring a temperature of the pressure roll as a steady state pressure roll temperature, b) causing media of the first type to be input to the fuser to fuse an image onto the media, the fuser having a first fusing temperature, c) causing the gloss meter to measure a gloss level of the image fused on the media, and sending the measured gloss level with the first type of media to the controller, d) causing steps b) and c) to be repeated at various fusing temperatures different from the first fusing temperature, e) in response to a user indication of a desired gloss level received over the user interface, setting a temperature of the pressure roll to the steady state pressure roll temperature, and f) fusing media utilizing one of the measured fusing temperatures corresponding to the desired gloss level, wherein the controller varies the fuser temperature by varying power levels of at least one of the heater rolls, the heater in the fuser roll and the heater in the pressure roll.

The disclosed embodiments further include a method of determining gloss levels for a plurality of fuser temperatures for media in a printing apparatus. The method includes a) causing fusing of a plurality of media of a first type at a nominal fusing temperature, and then measuring a temperature of the pressure roll as a steady state pressure roll temperature, b) inputting media of the first type to the fuser and fusing an image onto the media, the fuser having a first fusing temperature, c) measuring a gloss level of the image fused on the media with a gloss meter, and saving the measured gloss level with the first type of media, d) repeating steps b) and c) at various fusing temperatures different from the first fusing temperature, e) in response to a user indication of a desired gloss level received over the user interface, setting a temperature of the pressure roll to the steady state pressure roll temperature, and f) fusing media utilizing one of the measured fusing temperatures corresponding to the desired gloss level.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

Aspects of the embodiments disclosed herein relate to a xerographic printing apparatus that facilitates black and white printing, custom color printing as well as printing with primary colors (CMYK). The printing system may include one or a plurality of print engines, which may be linked by a common network of pathways connecting the print engines with each other and with an output destination. The print engines may all be under the control of a common controller or control system for printing images from a common print job stream. The printing apparatus can have a modular architecture that allows one or more print engines to be interchanged with other print engines. The printing apparatus enables custom color, and process color and/or black and white printing on the same sheet in a single printing system.

The term "print engine" refers to a device for applying an image to print media. Print media generally refers to a usually flimsy physical sheet of paper, plastic, or other suitable physical print media substrate for images, whether precut or web fed.

Gloss is the property of a substrate surface which involves specular reflection. Specular reflection is a sharply defined light beam resulting from reflection off a smooth, uniform surface. Gloss follows the law of reflection which states that when a ray of light reflects off a surface, the angle of incidence is equal to the angle of reflection. Gloss properties are generally measured in Gardner Gloss Units (ggu) by a gloss meter.

Gloss acceptability levels for copies and prints are dependent on the market segment involved. Some customers like glossy prints (e.g., above 80 ggu) while some customers prefer a more matte look (e.g., below 40 ggu), and some customers like the image gloss to match the paper gloss.

With reference now to FIG. 1, a printing apparatus (or image apparatus useful for printing) 100 suitable for implementing aspects of the exemplary embodiments is illustrated. The printing apparatus 100 generally includes a user interface 110, a digital front end (DFE) controller 120, and at least one print engine 130. The print engine 130 has access to media 135 of various sizes, types and cost for a print job. A "print job" or "document" is normally a set of related sheets, usually one or more collated copy sets copied from a set of original print job sheets or electronic document page images, from a particular user, or otherwise related. For submission of a regular print job (or customer job), digital data is generally sent to the printing system 100.

A sorter 140 operates after a job is printed by the print engine 130 to manage arrangement of the hard copy output, including cutting functions. A user can access and operate the printing apparatus 100 using the user interface 110 or via a workstation 150. The workstation 150 communicates with the printing apparatus 100 via a communications network 160. A user profile, a work product for printing, a media library, and various print job parameters can be stored in a database or memory 170 accessible by the workstation 150 or the printing apparatus 100 via the network 160, or such data can be directly accessed via the printing system 100. One or more color sensors (not shown) may be embedded in the printer paper path, as known in the art.

The printing system 100 may incorporate "tandem engine" printers, "parallel" printers, "cluster printing," "output merger" or "interposer" systems, and the like, as disclosed, for example, in U.S. Pat. No. 4,579,446 to Fujino, et al.; U.S. Pat. No. 4,587,532 to Asano; U.S. Pat. No. 5,489,969 to Soler, et al.; U.S. Pat. No. 5,568,246 to Keller, et al.; U.S. Pat. No. 5,570,172 to Acquaviva; U.S. Pat. No. 5,596,416 to Barry, et al.; U.S. Pat. No. 5,995,721 to Rourke, et al.; U.S. Pat. No. 6,554,276 to Jackson, et al., U.S. Pat. No. 6,654,136 to Shimida; and U.S. Pat. No. 6,607,320 to Bobrow, et al., the disclosures of all of these references being incorporated herein by reference.

Figure 2:
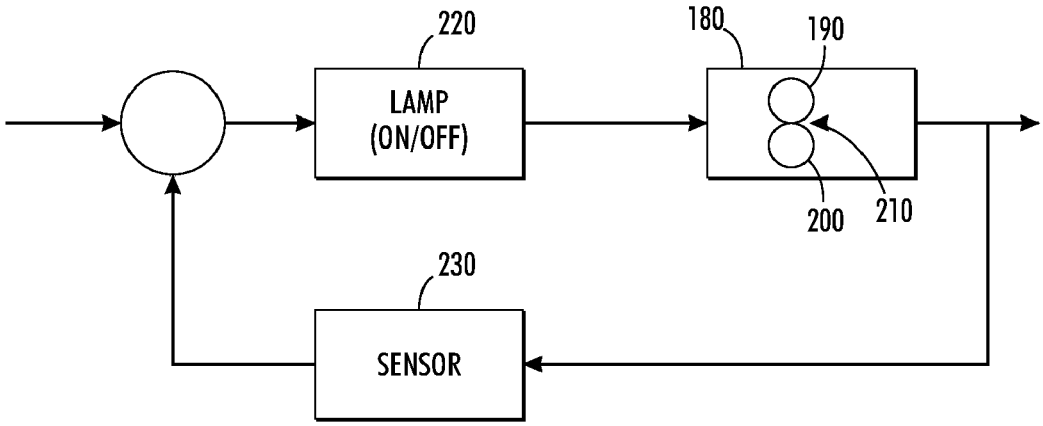
FIG. 2 depicts an exemplary embodiment of a fuser.

The print engine 130 further includes a fuser (or fusing system) 180, which is illustrated schematically in FIG. 2. By way of background, the typical xerographic imaging process is initiated by charging a photoconductive member to a uniform potential. An electrostatic latent image, corresponding with a print job, is then selectively discharged on the surface of the photoconductive member. A developer material is then brought into contact with the surface of the photoconductor to transform the latent image into a visible reproduction. The developer material includes toner particles with an electrical polarity opposite that of the photoconductive member, causing them to be naturally drawn to it. A blank media sheet is brought into contact with the photoreceptor and the toner particles are transferred to the sheet by the electrostatic charge of the media sheet. The toned or developed image is permanently affixed to the media sheet by subsequent application of heat to the sheet. The photoconductive member is then cleaned to remove any charge and/or residual developing material from its surface to prepare the photoconductive member for subsequent imaging cycles.

One preferred fusing method is to provide a heated fuser roll 190 in pressure contact with a back-up roll (pressure roll) or biased web member 200 to form a nip 210. A print media sheet is passed through the nip 210 to fix or fuse the toner powder image on the sheet. In one common example, the heated roll is heated by applying power to a heating element such as a lamp 220 located internally within the fuser roll that extends the width of the fuser roll 190. The heat from the lamp 220 is transferred to the fuser roll surface along the fusing area. Quartz lamps have been preferred for the heating element. The fusing system 180 may also incorporate one or more temperature sensors, referred to generally at 230.

Figure 3:
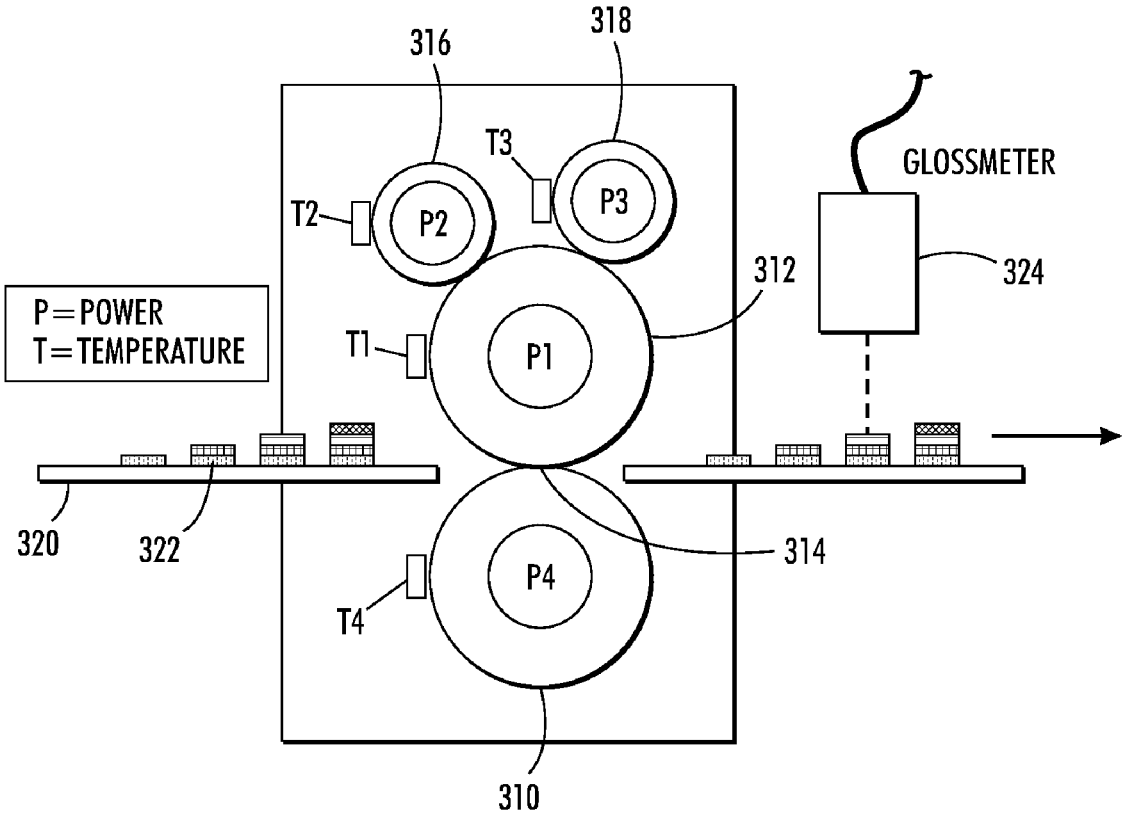
FIG. 3 is an enlarged view of a portion of the fuser shown in FIG. 2.

FIG. 3 illustrates further details of the fuser 180. The fuser may include pressure roll 310 and fuser roll 312 forming a nip 314, and heater rolls 316 and 318. Each of the pressure roll 310, fuser roll 312, and heater rolls 316 and 318 may have an associated heater lamp or heater element, and a temperature sensor T4, T1, T2 and T3, respectively. The temperature sensor T1 may be placed sufficiently close to nip 314 to effectively measure a fusing temperature at nip 314.

The embodiments may establish a pressure roll steady state temperature for each type of media, so that this temperature can be preset at the pressure roll 310. The steady state pressure roll temperature is the temperature the pressure roll would eventually stabilize at when fusing a plurality of media of a particular type. The embodiments can direct a plurality of media of a first type to be fused at a nominal fusing temperature, and then measure the temperature of the pressure roll 310, which may be saved as the steady state pressure roll temperature for that media type. This may be repeated for media of different types, each of which can have a separate steady state pressure roll temperature. The nominal fusing temperature may be set as a typical fusing temperature. For example, the nominal fusing temperature may be 195 degrees Celsius for heavyweight coated media and 185 degrees Celsius for other media.

The embodiments can direct media 320 to have an image fused thereto at the nip 314 at a fusing temperature, and a gloss of the media 320 can be measured by gloss meter 324.

The controller 120 may control the embodiments to fuse an image to the media at a first fuser temperature and measure the gloss level with gloss meter 324, and then to repeatedly fuse a media of the same type at different fuser temperatures while measuring the resultant gloss. This allows the controller 120 to save the resultant fuser temperatures versus gloss levels for the media. This process can be repeated with various types of media to build up a library of fuser temperatures versus gloss levels for different types of media. A user can then enter a desired gloss level at user interface 110, and the controller 120 can set the steady state pressure roll temperature and then look up the corresponding fuser temperature to apply to achieve the desired gloss level.

In addition, an image or pixels within an image may be formed from one or a plurality of layers on a media sheet. For example, color xerographic systems may utilize 1-4 layers or more of toner on media to form different colors. An image or portion of an image could comprise 2 layers 322 on a media sheet 320, for example. It has been determined that the number of layers can change the resultant gloss at a same fuser temperature.

Accordingly, embodiments may cause media 320 to have an image fused thereto at the nip 314 at a first fusing temperature with a first number of image layers, and a gloss of the media 320 can be measured by gloss meter 324. Then, media of the same type is fused with the same number of layers at different fuser temperatures while measuring the resultant gloss. This process may be repeated while varying the number of layers, and then while varying the type of media.

The controller 120 can save a library of fuser temperature versus gloss for each of a plurality of media types, and for each of a plurality of numbers of layers. When the user is later printing on a media of a particular type and a desired gloss level is requested, the controller 120 can select the appropriate fuser temperature based on the type of media, and the number of layers. The controller can determine a number of layers in an image or portion of an image and select an appropriate fuser temperature to achieve the desired gloss level.

The term "fuser temperature" as used herein may be a direct measurement of a temperature at nip 314 where fusing of the image actually occurs. In addition, embodiments may vary power levels of heaters at the fuser roll 312 or the heater rolls 316, 318 (or other heaters) which will vary the fuser temperature and be an indirect measurement of the fuser temperature, and then measure the resultant gloss. The embodiments could then apply the corresponding power levels to heaters to achieve the desired gloss, which would still apply the corresponding fuser temperature.

Figure 4:
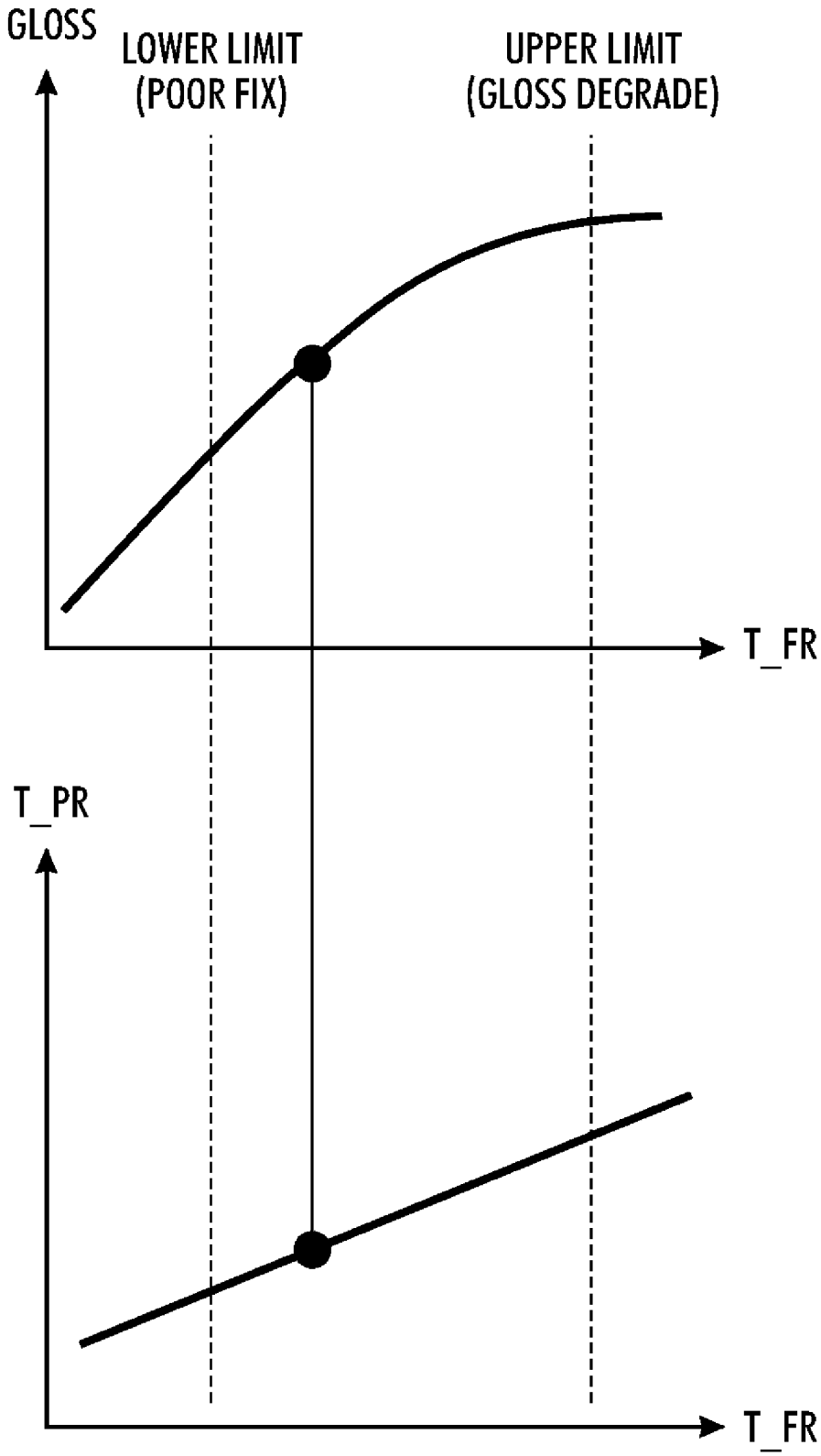
FIG. 4 depicts a chart illustrating gloss versus temperatures curves.

FIG. 4 illustrates a gloss versus fuser temperature chart. This chart illustrates how the fuser temperature can be varied from a lower limit gloss condition to an upper limit gloss condition, and the gloss versus fuser temperature values can be saved.

The lower chart illustrates pressure roll temperature versus fuser temperature. These values may be used when there is a heater in the pressure roll 310.

Figure 5:
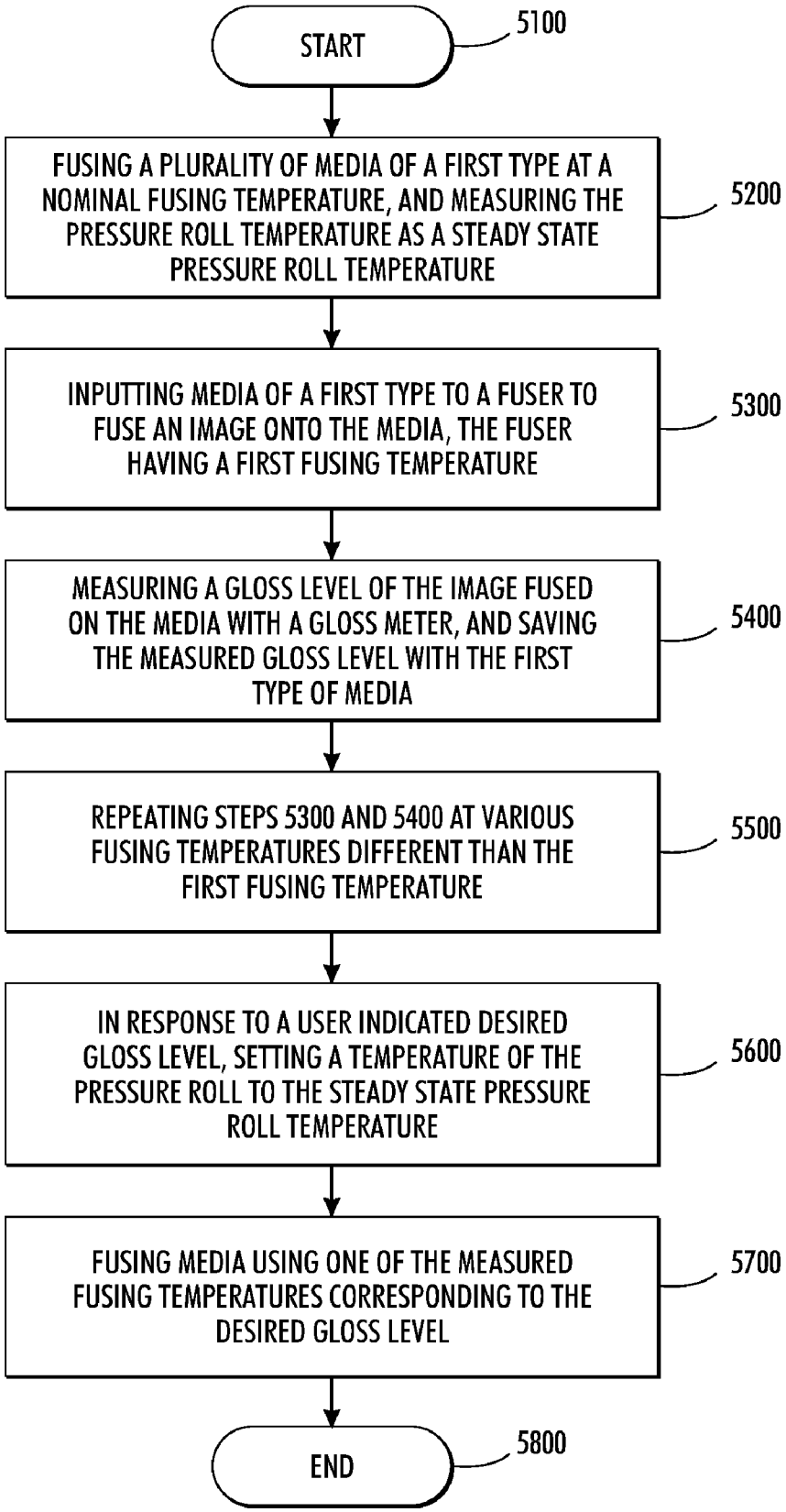
FIG. 5 depicts a flowchart illustrating a method according to the invention.

FIG. 5 illustrates a flowchart illustrating methods of the embodiments. In 5100, the method starts.

In 5200, a plurality of media of a first type are fused at a nominal fusing temperature. The pressure roll temperature is measured and saved as the steady state pressure roll temperature.

In 5300, media of a first type are input to a fuser and fused. The fuser has a first fusing temperature.

In 5400, a gloss level of the image is measured with a gloss meter. The measured gloss level with the corresponding fuser temperature is saved.

In 5500, steps 5300 and 5400 are repeated at various fusing temperatures different than the first temperature. The fuser temperatures are varied to obtain various corresponding gloss levels, from a low gloss level to a high gloss level.

In 5600, in response to a user indicated gloss level, a temperature of the pressure roll is set to the steady state pressure roll temperature.

In 5700, media is fused using one of the measured fusing temperatures corresponding to the desired gloss level. In 5800 the process ends.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed:

1. An apparatus useful for printing, comprising:

a user interface for operating the printing apparatus;

a fuser for fusing media, the fuser having a fuser roll and a pressure roll, and a plurality of fuser temperature settings;

a gloss meter for measuring gloss of an image fused on the media; and a controller controlling the printing apparatus, wherein the controller:

a) causes fusing of a plurality of media of a first type at a nominal fusing temperature, and then measuring a temperature of the pressure roll as a steady state pressure roll temperature;

b) causes media of the first type to be input to the fuser to fuse an image onto the media, the fuser having a first fusing temperature;

c) causes the gloss meter to measure a gloss level of the image fused on the media, and sending the measured gloss level with the first type of media to the controller;

d) causes steps b) and c) to be repeated at various fusing temperatures different from the first fusing temperature, and saving the measured gloss levels with corresponding fuser temperatures;

e) in response to a user indication of a desired gloss level received over the user interface, sets a temperature of the pressure roll to the steady state pressure roll temperature; and f) fuses media utilizing one of the measured fusing temperatures corresponding to the desired gloss level.

2. The apparatus of claim 1, wherein the controller repeats steps a), b), c) and d) for each of a plurality of media types different from the first media type.

3. The apparatus of claim 2, wherein the media of different types comprise media of different weights.

4. The apparatus of claim 2, wherein the media of different types comprise coated media and uncoated media.

5. The apparatus of claim 2, wherein the controller receives an input of a user selected media type from a user over the user interface and determines fuser temperatures for a plurality of gloss levels for the user selected media type.

6. The apparatus of claim 1, wherein in b) the image has a first number of layers, wherein the controller causes steps b), c) and d) to be repeated for a plurality of media each having an image with a number of layers different than the first number of layers.

7. The apparatus of claim 2, wherein in b) the image has a first number of layers, wherein the controller causes steps b), c) and d) to be repeated for a plurality of media each having an image with a number of layers different than the first number of layers.

8. An apparatus useful for printing, comprising:

a user interface for operating the printing apparatus;

a fuser for fusing media, the fuser having a fuser roll with a heater, a pressure roll with a heater, the fuser roll and the pressure roll forming a nip for fusing media, and having heater rolls adjacent the fuser roll for applying heat to the fuser roll;

a gloss meter for measuring gloss of an image fused on the media; and a controller controlling the printing apparatus, wherein the controller determines gloss levels of media for a plurality of fuser temperatures by:

a) causing fusing of a plurality of media of a first type at a nominal fusing temperature, and then measuring a temperature of the pressure roll as a steady state pressure roll temperature;

b) causing media of the first type to be input to the fuser to fuse an image onto the media, the fuser having a first fusing temperature;

c) causing the gloss meter to measure a gloss level of the image fused on the media, and sending the measured gloss level with the first type of media to the controller;

d) causing steps b) and c) to be repeated at various fusing temperatures different from the first fusing temperature;

e) in response to a user indication of a desired gloss level received over the user interface, setting a temperature of the pressure roll to the steady state pressure roll temperature; and f) fusing media utilizing one of the measured fusing temperatures corresponding to the desired gloss level, wherein the controller varies the fuser temperature by varying power levels of at least one of the heater rolls, the heater in the fuser roll and the heater in the pressure roll.

9. The apparatus of claim 8, wherein the controller repeats steps a), b), c) and d) for each of a plurality of media types different from the first media type.

10. The apparatus of claim 9, wherein the media of different types comprise media of different weights, coated media or uncoated media.

11. The apparatus of claim 8, wherein the controller receives an input of a user selected media type from a user over the user interface and determines fuser temperatures for a plurality of gloss levels for the user selected media type.

12. The apparatus of claim 8, wherein in b) the image has a first number of layers, wherein the controller causes steps b), c) and d) to be repeated for a plurality of media each having an image with a number of layers different than the first number of layers.

13. The apparatus of claim 12, wherein the controller receives an input of a user selected gloss level over the user interface, and determines a fuser temperature corresponding to the user selected gloss level and corresponding to a number of image layers in an image to be fused.

14. A method of determining gloss levels for a plurality of fuser temperatures for media in a printing apparatus, the fuser having a fuser roll and a pressure roll, the method comprising:

a) causing fusing of a plurality of media of a first type at a nominal fusing temperature, and then measuring a temperature of the pressure roll as a steady state pressure roll temperature;

b) inputting media of the first type to the fuser and fusing an image onto the media, the fuser having a first fusing temperature;

c) measuring a gloss level of the image fused on the media with a gloss meter, and saving the measured gloss level with the first type of media;

d) repeating steps b) and c) at various fusing temperatures different from the first fusing temperature;

e) in response to a user indication of a desired gloss level received over a user interface, setting a temperature of the pressure roll to the steady state pressure roll temperature; and f) fusing media utilizing one of the measured fusing temperatures corresponding to the desired gloss level.

15. The method of claim 14, further comprising repeating steps a), b), c) and d) for each of a plurality of media types different from the first media type.

16. The method of claim 15, wherein the media of different types comprise media of different weights.

17. The method of claim 15, wherein the media of different types comprise coated media and uncoated media.

18. The method of claim 14, further comprising receiving an input of a user selected media type from a user over the user interface and determining fuser temperatures for a plurality of gloss levels for the user selected media type.

19. The method of claim 14, wherein in b) the image has a first number of layers, wherein the controller causes steps b), c) and d) to be repeated for a plurality of media each having an image with a number of layers different than the first number of layers.

20. The method of claim 19, further comprising receiving an input of a user selected gloss level over the user interface, and determining a fuser temperature corresponding to the user selected gloss level and corresponding to a number of image layers in an image to be fused.

* * * * *